US009812250B2

(12) United States Patent
Ono et al.

(10) Patent No.: US 9,812,250 B2
(45) Date of Patent: Nov. 7, 2017

(54) TRANSFORMER

(71) Applicant: Hitachi, Ltd., Chiyoda-ku, Tokyo (JP)

(72) Inventors: Yasunori Ono, Tokyo (JP); Takahide Matsuo, Tokyo (JP); Naoya Miyamoto, Tokyo (JP); Taku Oyama, Tokyo (JP); Kentaro Koseki, Tokyo (JP); Ryoji Hirobe, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 235 days.

(21) Appl. No.: 14/738,993

(22) Filed: Jun. 15, 2015

(65) Prior Publication Data

US 2016/0086726 A1 Mar. 24, 2016

(30) Foreign Application Priority Data

Sep. 19, 2014 (JP) ..... 2014-190672

(51) Int. Cl.

| | |
|---|---|
| ***H01F 27/02*** | (2006.01) |
| ***H01F 27/08*** | (2006.01) |
| ***H01F 27/10*** | (2006.01) |
| ***H01F 27/36*** | (2006.01) |
| *H01F 27/34* | (2006.01) |

(52) U.S. Cl.
CPC ..... *H01F 27/365* (2013.01); *H01F 27/02* (2013.01); *H01F 2027/348* (2013.01)

(58) Field of Classification Search
CPC ..... H01F 27/02; H01F 27/022; H01F 38/12
USPC ..... 336/55, 57, 58, 51, 90, 92, 94
See application file for complete search history.

(56) References Cited

U.S. PATENT DOCUMENTS 4,047,139 A * 9/1977 Fukuda ..... H01F 27/2823 323/255
6,469,607 B1 * 10/2002 Hamadate ..... H01F 27/367 336/84 M

FOREIGN PATENT DOCUMENTS

| | | | |
|---|---|---|---|
| JP | 03006805 A | * | 1/1991 |
| JP | 08124767 A | * | 5/1996 |
| JP | 09045553 A | * | 2/1997 |
| JP | 9-293622 A | | 11/1997 |
| JP | 10-116741 A | | 5/1998 |
| JP | 11144981 A | * | 5/1999 |
| JP | 2000353625 A | * | 12/2000 |

* cited by examiner

*Primary Examiner* — Tsz Chan
(74) *Attorney, Agent, or Firm* — Crowell & Moring LLP

(57) ABSTRACT

While the whole weight of magnetic shields provided in a tank of a transformer is reduced, eddy current loss by magnetic flux leaked from a winding is reduced. A transformer is configured using an iron core having an iron core leg and an iron core yoke, windings wound around the iron core leg, a tank having the iron core and the windings therein, and a first magnetic shield and second magnetic shields formed by laminating silicon steel sheets inside the tank. The first magnetic shield is arranged opposite to the windings, the second magnetic shields are arranged between the first magnetic shield and the tank, and the first magnetic shield and the second magnetic shields are fixed to the tank by different support members.

4 Claims, 11 Drawing Sheets

TRANSFORMER

BACKGROUND

The present invention relates to a transformer, and particularly to a transformer having magnetic shields in a tank.

In a transformer configured using an iron core including an iron core leg part and an iron core yoke part and a winding wound around the iron core leg part, magnetic flux leaked from the winding enters a tank or an iron core fastening metal fitting for fixing the iron core, and eddy current loss is generated.

Recently, the transformer is downsized to reduce the manufacturing cost, and the density of leaked magnetic flux tends to be increased. In order to reduce the loss by the leaked magnetic flux, it is desirable to reduce the loss in the tank or the iron core fastening metal fitting.

Japanese Unexamined Patent Application Publication No. Hei10 (1998)-116741 is one of the background techniques of the technical field. The publication describes a structure in which in a magnetic shield that is arranged on the surface of a tank and obtained by laminating silicon steel sheets, a magnetic shield part obtained by laminating silicon steel sheets is provided in the rear of the surface opposite to a winding.

Further, Japanese Unexamined Patent Application Publication No. Hei9(1997)-293622 is also one of the background techniques. The publication describes a structure in which a two-layer magnetic shield formed using a magnetic shield obtained by laminating silicon steel sheets and a magnetic shield surrounded by sound absorbing materials is attached to a tank.

SUMMARY

In the structure described in Japanese Unexamined Patent Application Publication No. Hei10(1998)-116741, the magnetic flux leaked from the iron core is absorbed by the magnetic shield in which the magnetic shield part is provided in the rear of the surface opposite to the winding, and can return to the iron core side without being leaked on the tank side. Thus, the eddy current loss in the tank can be reduced considerably. On the other hand, in order to allow the all magnetic flux to flow without magnetic saturation of the magnetic shield, the magnetic shield part needs to be considerably thickened. Accordingly, the weight of the magnetic shield is increased. Thus, there are problems that the cost of the material of the silicon steel sheet is increased, that the fixing structure of the magnetic shield is complicated, and that the workability of manufacturing the magnetic shield is deteriorated.

In the structure described in Japanese Unexamined Patent Application Publication No. Hei9(1997)-293622, the eddy current loss in the tank can be reduced considerably because the two-layer magnetic shield is used. On the other hand, the weight of the magnetic shield is increased because two layers of magnetic shields are laminated. As a result, the same problems as in Japanese Unexamined Patent Application Publication No. Hei10(1998)-116741 occur.

The present invention has been made in view of the foregoing problems, and an object thereof is to reduce eddy current loss by magnetic flux leaked from a winding while reducing the whole weight of magnetic shields provided in a tank of a transformer.

In order to solve the above-described problems, for example, configurations described in claims are adopted.

The application includes plural means for solving the above-described problems. As an example, the present invention provides a transformer in which an iron core having an iron core leg and an iron core yoke, windings wound around the iron core leg, and magnetic shields formed by laminating silicon steel sheets are arranged in a tank. A first magnetic shield fixed by a support structure provided in the tank is arranged opposite to the windings, and second magnetic shields fixed by a different support structure are arranged between the first magnetic shield and the tank.

The whole weight of magnetic shields necessary to reduce eddy current loss in a tank can be reduced, and the eddy current loss by magnetic flux leaked from a winding can be reduced.

DETAILED DESCRIPTION

Hereinafter, embodiments will be described using the drawings.

First Embodiment

In the present embodiment, an example of a single-phase transformer having a voltage switching winding (a tap winding) that is arranged at a position nearest to a tank will be described.

Figure 1:
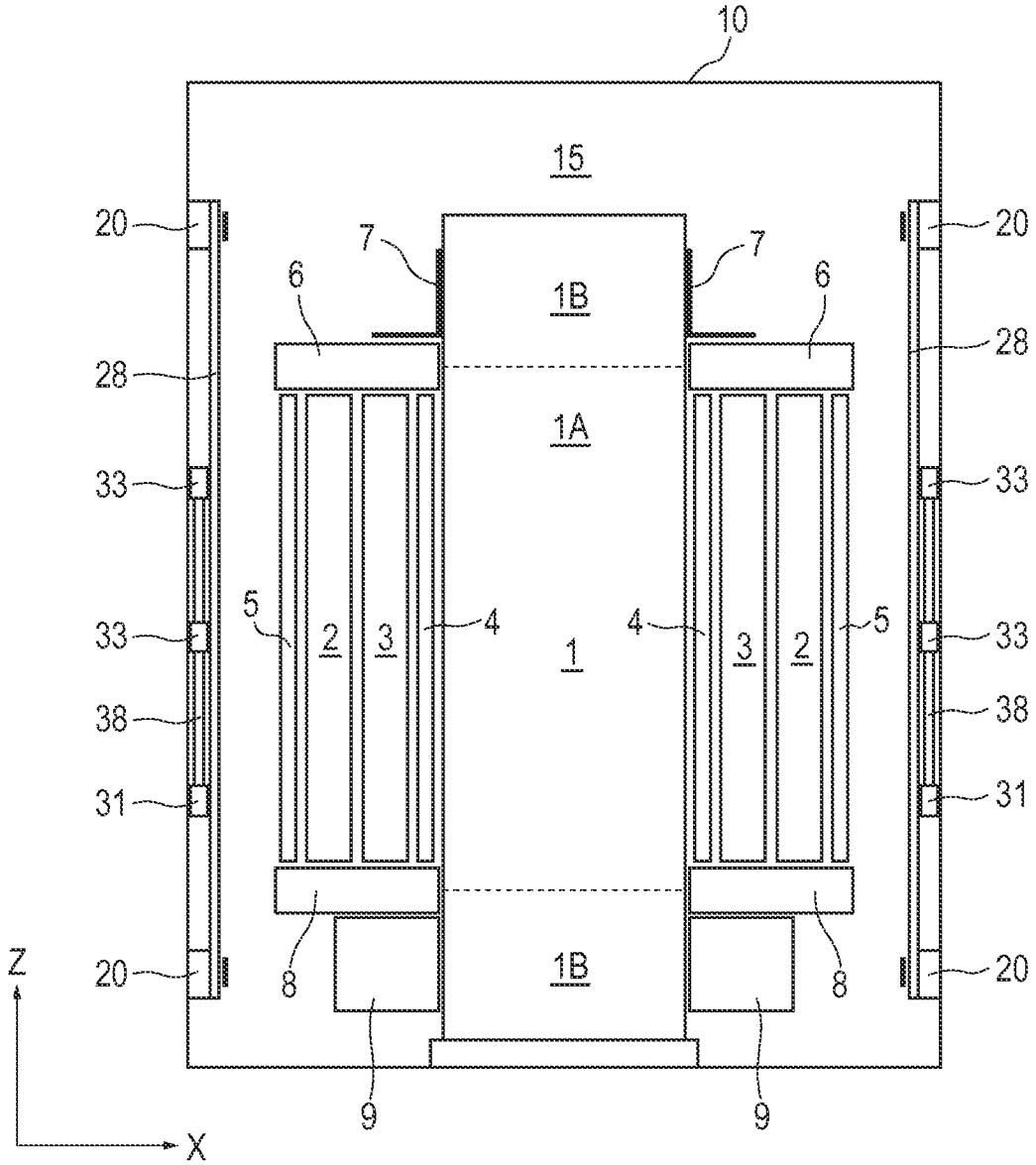
FIG. 1 is a vertical cross-sectional view for showing main parts of a transformer in a first embodiment.

FIG. 1 is a vertical cross-sectional view for showing main parts of the transformer of the present embodiment. The main parts of the transformer roughly include an iron core 1 configured using an iron core leg part 1A and iron core yoke parts 1B formed by laminating plural silicon steel sheets, a high-voltage side winding 2 wound around the iron core leg part 1A, a low-voltage side winding 3, a tertiary winding 4, and a voltage switching winding 5. The iron core 1 is fixed by an upper iron core fastening metal fitting 7 arranged above the windings across an upper insulator 6 and a lower iron core fastening metal fitting 9 arranged under the windings across a lower insulator 8.

The above-described iron core 1 and windings are arranged in a tank 10. First magnetic shield support structures 20 are provided on the inner wall of the tank 10, and thereby a first magnetic shield 28 is fixed. Further, a second magnetic shield lower support member 31 and second magnetic shield support members 33 are provided on the inner wall of the tank, and a second magnetic shield 38 is fixed between the first magnetic shield and the tank. The tank 10 is filled with insulating oil 15.

The magnetic shields 28 and 38 are formed by laminating plural silicon steel sheets in which holes for attachment at predetermined positions are provided.

Figure 2:
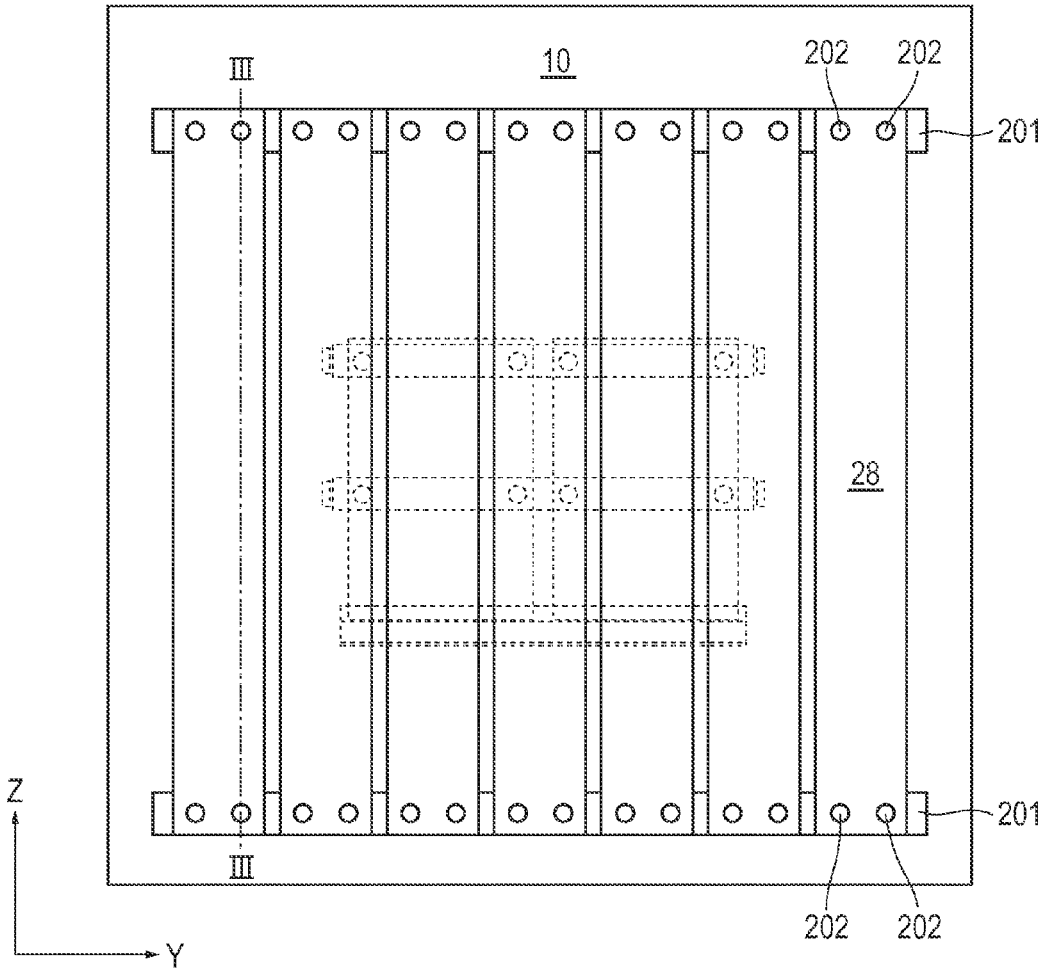
FIG. 2 is a front view for showing a structure of attaching a first magnetic shield to a tank.

Next, a fixing method of the first magnetic shield will be described using FIG. 2 and FIG. 3. FIG. 2 is a front view for showing a structure of attaching the first magnetic shield to the tank. A first magnetic shield fixing base 201 is provided at each of upper and lower portions of the inner wall of the tank 10. Longitudinal magnetic shields 28 in which holes for attachment are provided are fixed to the first magnetic shield fixing bases 201 through first magnetic shield fixing parts 202. It should be noted that the dashed lines in the drawing denote rough positions of the second magnetic shield and support structures.

Figure 3:
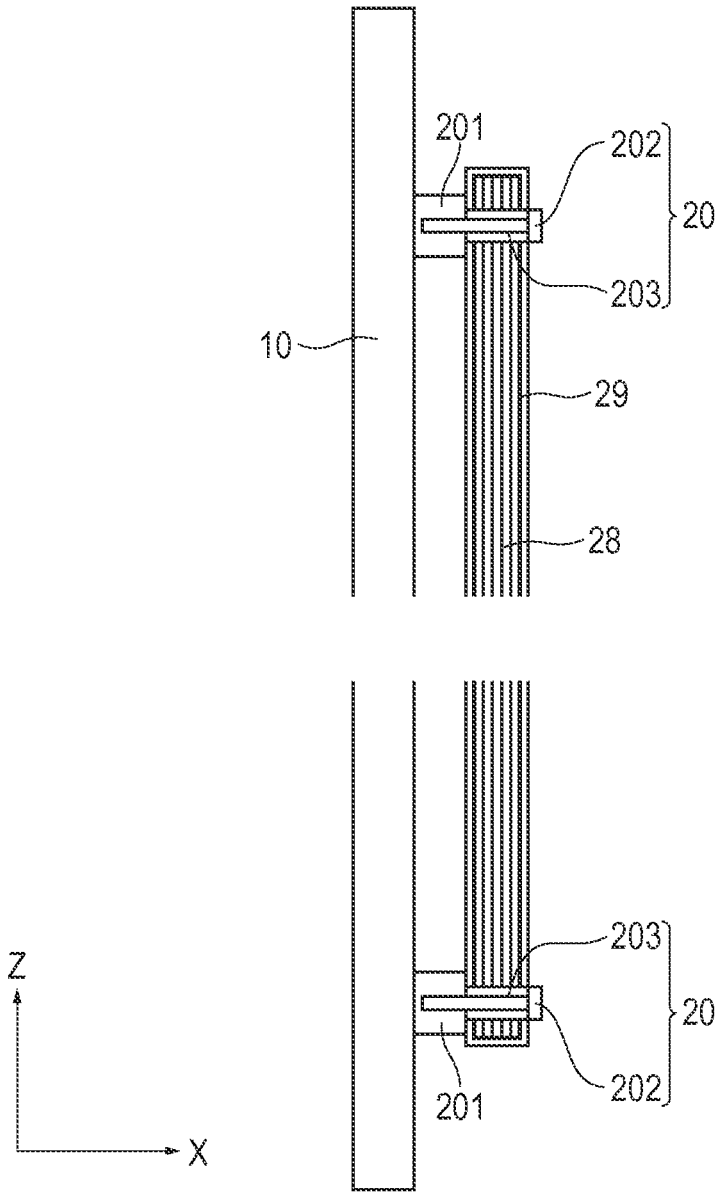
FIG. 3 is a vertical cross-sectional view taken along the line III-III of FIG. 2.

FIG. 3 is a vertical cross-sectional view taken along the line III-III of FIG. 2. Cylindrical insulating members 203 are arranged inside the holes provided in the first magnetic shields 28 around which a first magnetic shield protective insulator 29 covers, and the first magnetic shields 28 are fixed to the first magnetic shield fixing bases 201 through the first magnetic shield fixing parts 202.

It should be noted that the weight of the first magnetic shield 28 is equalized with that of the second magnetic shield 38, and thus fixing members for fixing the same can be commonly used. As a result, the workability can be improved.

Next, a fixing method of the second magnetic shield will be described using FIG. 4 and FIG. 5. A second magnetic shield lower support base 311 and two second magnetic shield fixing bases 331 in this order from the lower side are fixed to the middle portion of the inner wall of the tank by welding or the like.

The second magnetic shield 38 is arranged on the magnetic shield lower support base 311 to be covered with a second magnetic shield lower cover 312, and the second magnetic shield lower cover 312 is fixed to the magnetic shield lower support base 311 by second magnetic shield lower cover fixing members 313 such as bolts. Accordingly, the second magnetic shield 38 can be prevented from falling from the second magnetic shield lower support base 311.

The second magnetic shield 38 is further fixed while being sandwiched between second magnetic shield fixing bases 331 and second magnetic shield covers 333. Specifically, cylindrical fixed base protruding parts 332 are provided to the second magnetic shield fixing bases 331, and are inserted into the holes provided in the magnetic shield 38. Then, second magnetic shield covers 333 formed in an inverse C-shape are arranged at the tip ends of the protruding parts, and the both ends of the covers are fixed to the second magnetic shield fixing bases 331 through second magnetic shield cover fixing members 334 such as bolts.

Figure 4:
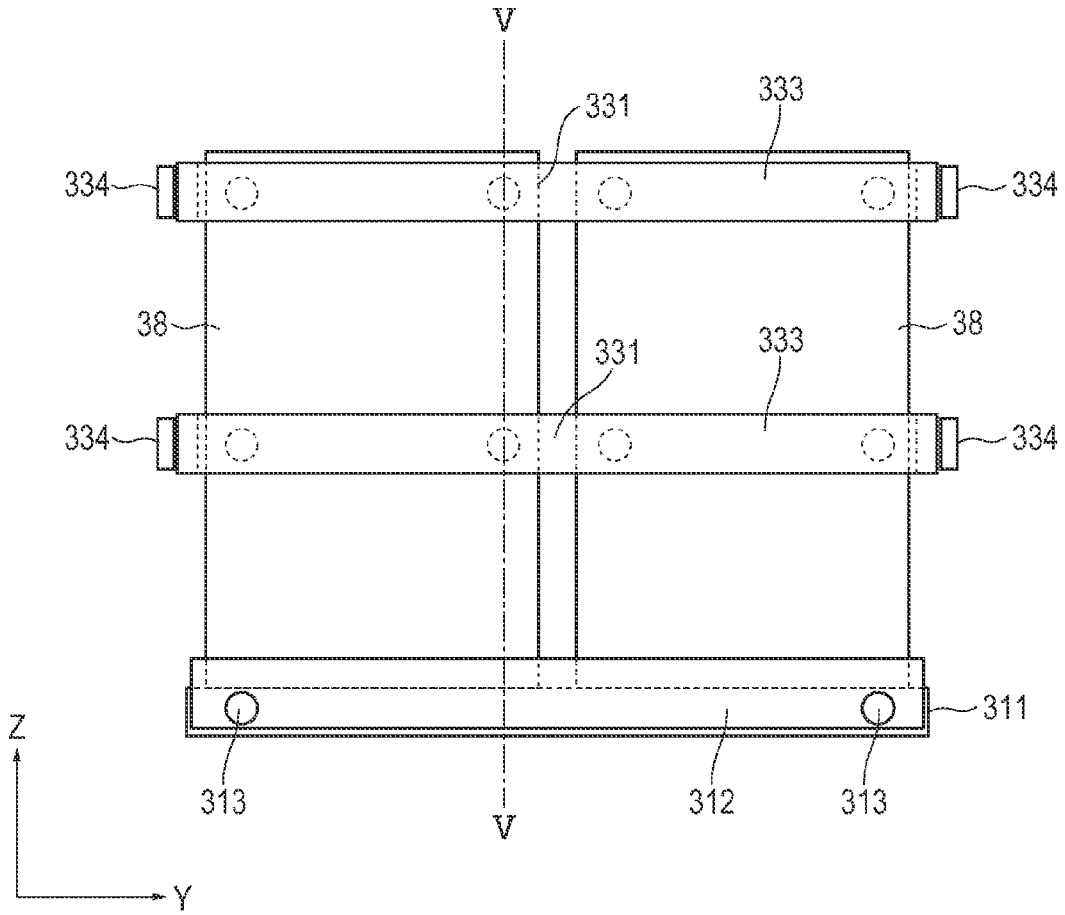
FIG. 4 is a diagram for showing details of a second magnetic shield.
Figure 5:
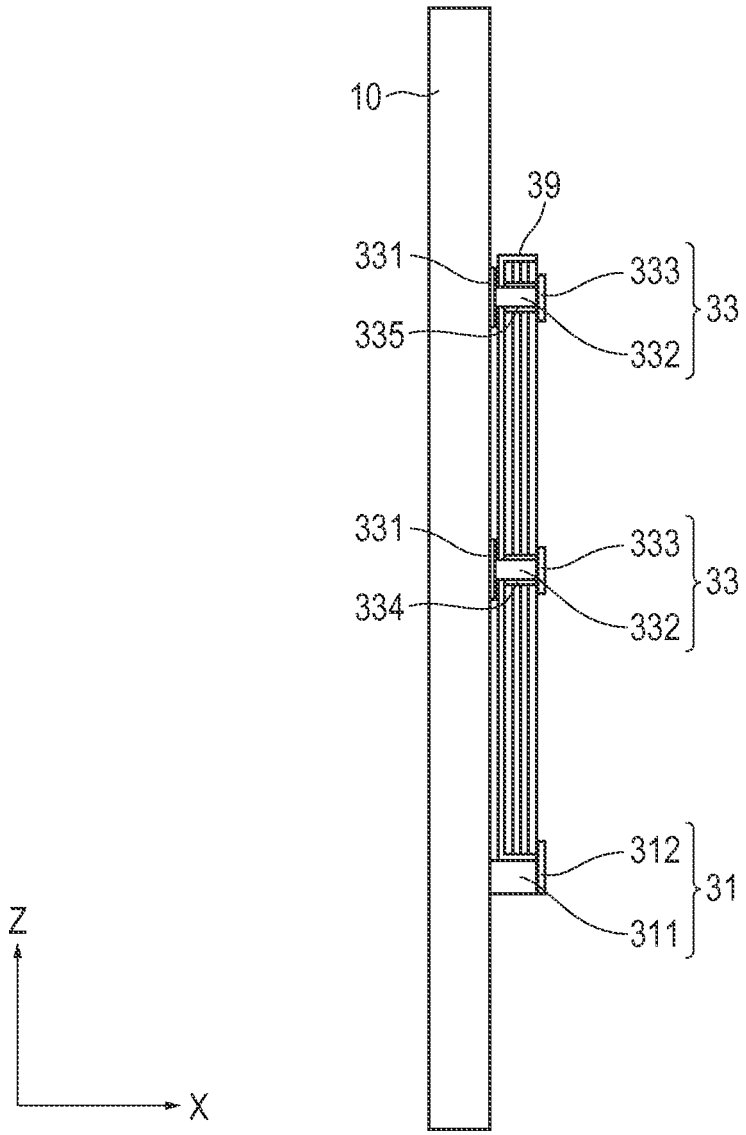
FIG. 5 is a vertical cross-sectional view taken along the line V-V of FIG. 4.

FIG. 5 is a vertical cross-sectional view taken along the line V-V of FIG. 4. The cylindrical fixed base protruding parts 332 are provided at predetermined positions of the second magnetic shield fixing parts 331. Around the fixed base protruding parts 332, arranged are cylindrical insulating members 335 which are inserted into the positions of the holes of the second magnetic shield 38 around which a second magnetic shield protective insulating member 39 covers. The second magnetic shield 38 does not fall down because the second magnetic shield 38 is pressed by the second magnetic shield covers 333. In addition, even when a force is applied to the second magnetic shield 38, the second magnetic shield 38 is not vertically moved.

Figure 6:
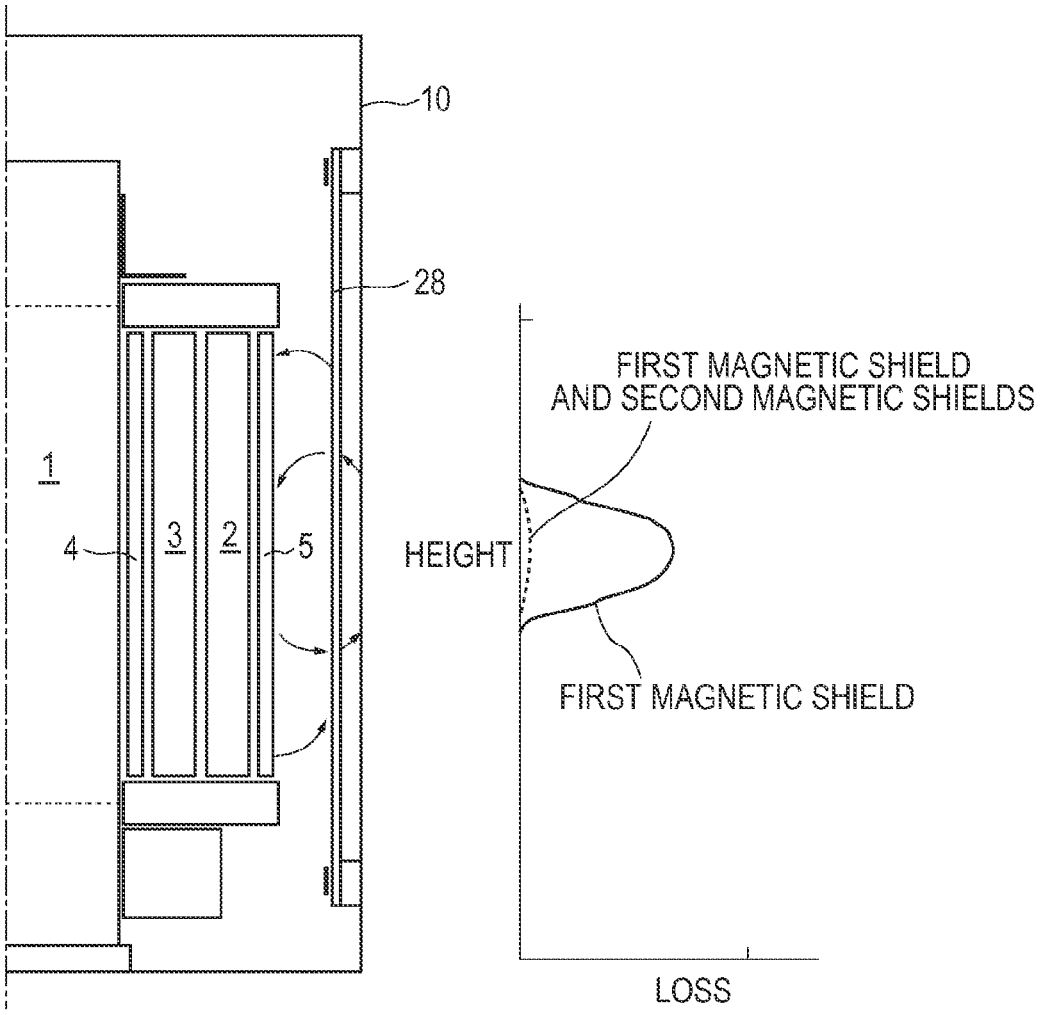
FIG. 6 shows a schematic view for showing effects of the first embodiment and a graph of loss distribution, and the height of the schematic view and the height of the graph are associated with each other.

Next, effects of the present embodiment will be described with reference to FIG. 6. FIG. 6 shows a schematic view for showing effects of the present embodiment and a graph of loss distribution, and the height of the schematic view and the height of the graph are associated with each other. The arrows in the schematic view qualitatively show the flow of magnetic flux. For example, the magnetic flux generated from a lower end of the winding is taken into the first magnetic shield 28, and then returns to an upper end of the winding. However, when the voltage switching winding 5 is arranged on the side of the tank 10, the magnetic flux is further overlapped around the middle portion of the first magnetic shield 28. Therefore, the magnetic saturation of the magnetic shield occurs around the middle portion of the first magnetic shield 28, and the magnetic flux is leaked on the side of the tank 10, resulting in the loss distribution in which the loss is maximized in the middle of the tank.

In this case, there is a problem that the loss is increased as the whole transformer and the temperature is locally raised. However, in the configuration of the present invention in FIG. 1, the magnetic flux leaked on the side of the tank 10 around the middle portion of the first magnetic shield 28 is adsorbed by the second magnetic shield 38, and flows into the second magnetic shield 38. Thereafter, the magnetic flux returns to the first magnetic shield 28, and finally returns to an upper portion of the winding. Therefore, the magnetic flux entering the tank 10 is reduced considerably, and the peak of the loss is reduced to 10% or lower.

The required area of the second magnetic shield 38 is narrow as compared to that of the first magnetic shield 28, and the whole weight of the magnetic shields can be minimized. Thus, the magnetic shields can be fixed using the simple attachment structures as shown in FIG. 2 to FIG. 4. Further, plural first magnetic shields 28 and second magnetic shields 38 are arranged while equalizing each weight. As a result, the workability is considerably improved as compared to a case in which one magnetic shield having a large area and heavy weight is used. Further, the oscillation can be advantageously suppressed by reducing the weight of one magnetic shield.

Second Embodiment

Figure 7:
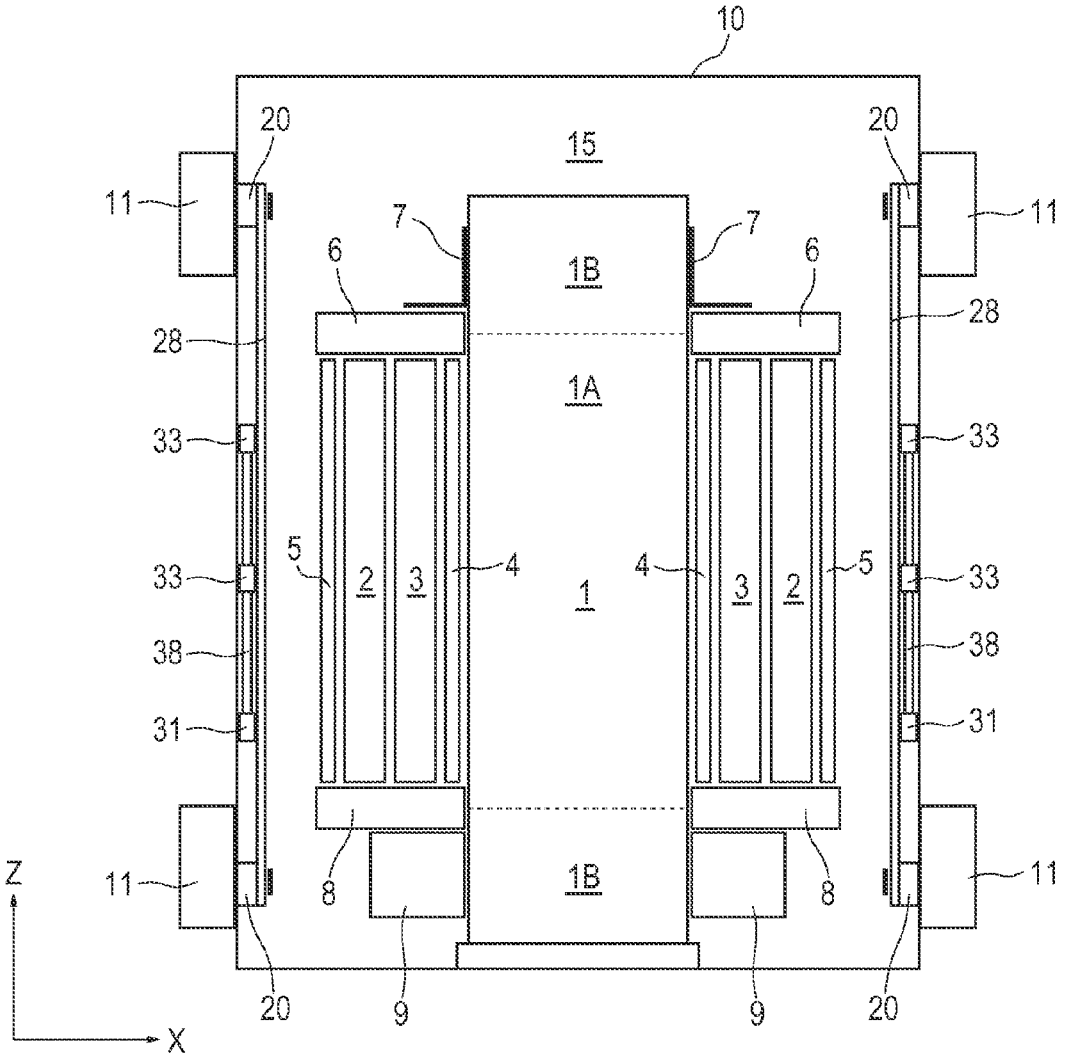
FIG. 7 is a vertical cross-sectional view for showing main parts of a transformer in a second embodiment.

In the present embodiment, an example of a single-phase transformer for which low noise is particularly required will be described. FIG. 7 is a vertical cross-sectional view for showing main parts of the transformer in the present embodiment. The transformer of the present embodiment is substantially the same as that shown in FIG. 1. However, hollow reinforced structures 11 formed in a square pillar shape are provided outside the tank 10. The explanation for the configurations to which the same reference numerals are given and the constitutional elements having the same functions shown in FIG. 1 will be omitted.

In the present embodiment, the first magnetic shield support structures 20 are provided opposite to the reinforced structures 11 of the tank 10. The oscillation can be reduced by reducing the weights of the magnetic shields 28 and 38 of the present invention. However, the first magnetic shield 28 occupying most of the magnetic shield is fixed to the inner wall of the tank opposite to the reinforced structures 11 that are hardly oscillated. Accordingly, the propagation of oscillation to the atmosphere hardly occurs, and the noise can be suppressed.

Third Embodiment

In the present embodiment, an example of a single-phase transformer having a voltage switching winding (a tap winding) in which the voltage switching winding is arranged at a position nearer to the iron core 1 than the high-voltage side winding 2 and the low-voltage side winding 3 will be described.

Figure 8:
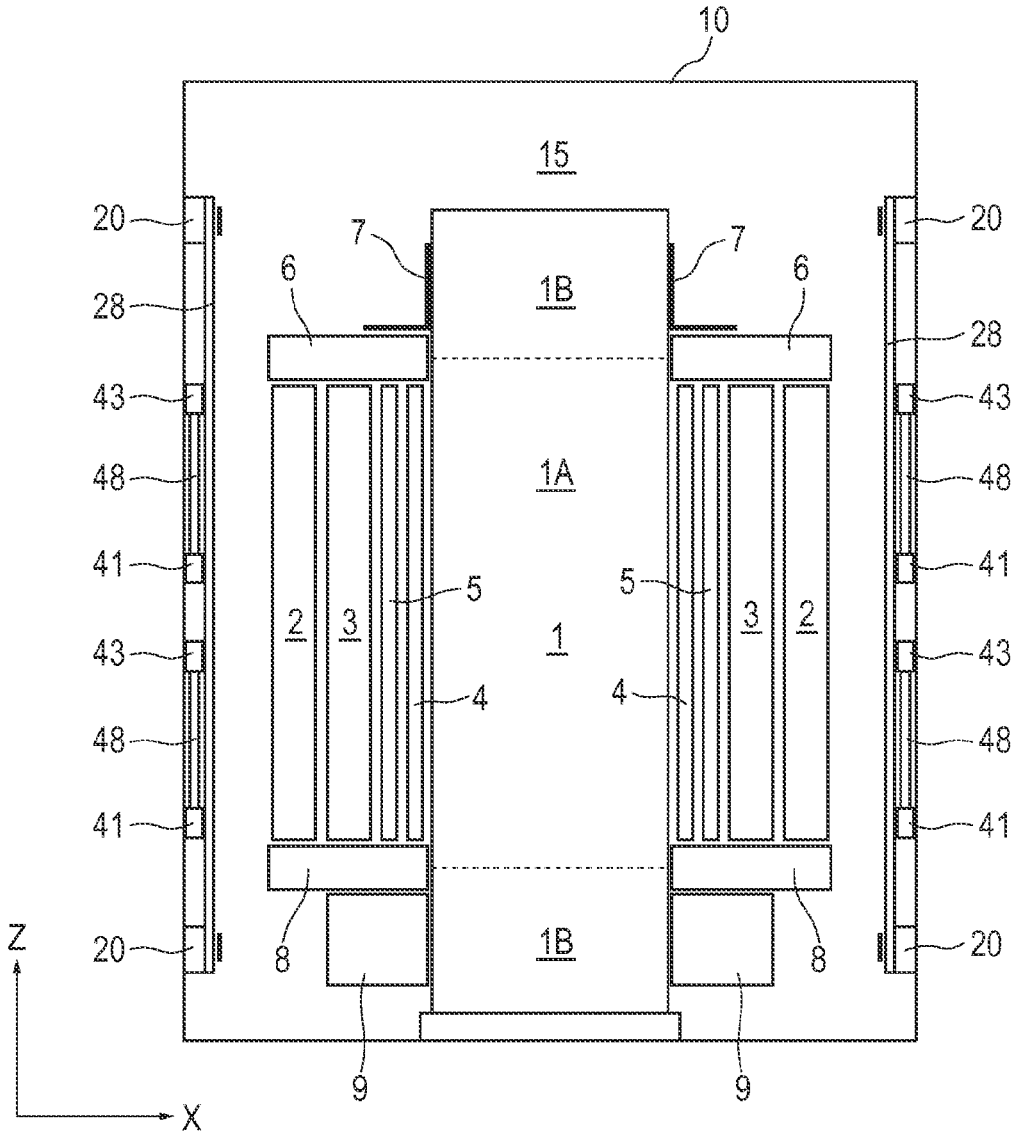
FIG. 8 is a vertical cross-sectional view for showing main parts of a transformer in a third embodiment.

FIG. 8 is a vertical cross-sectional view for showing main parts of a transformer in the present embodiment. The transformer of the present embodiment is substantially the same as that shown in FIG. 1, but is different in that two second magnetic shields 48 arranged on the upper and lower sides are fixed by second magnetic shield lower support members 41 and second magnetic shield support members 43. The explanation for the configurations to which the same reference numerals are given and the constitutional elements having the same functions shown in FIG. 1 will be omitted.

Figure 9:
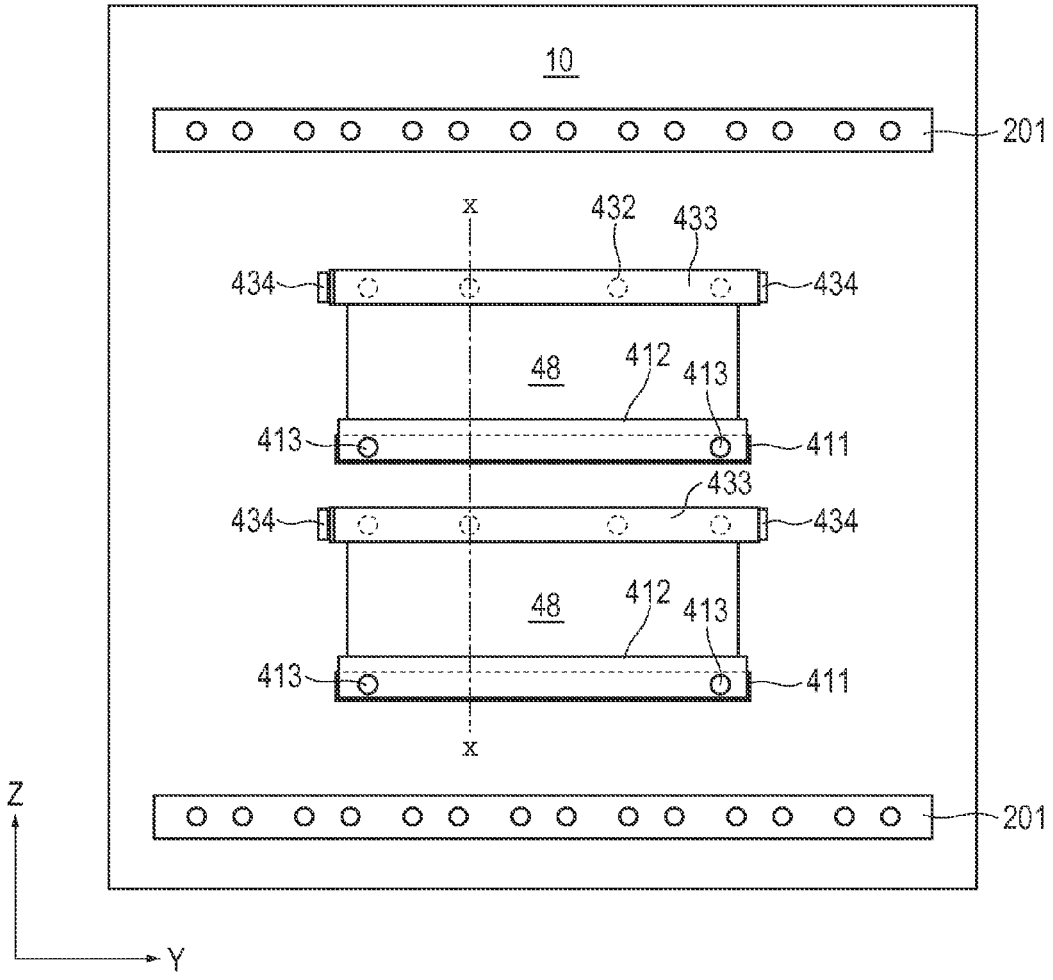
FIG. 9 is a front view for showing a structure of attaching a second magnetic shield to a tank.
Figure 10:
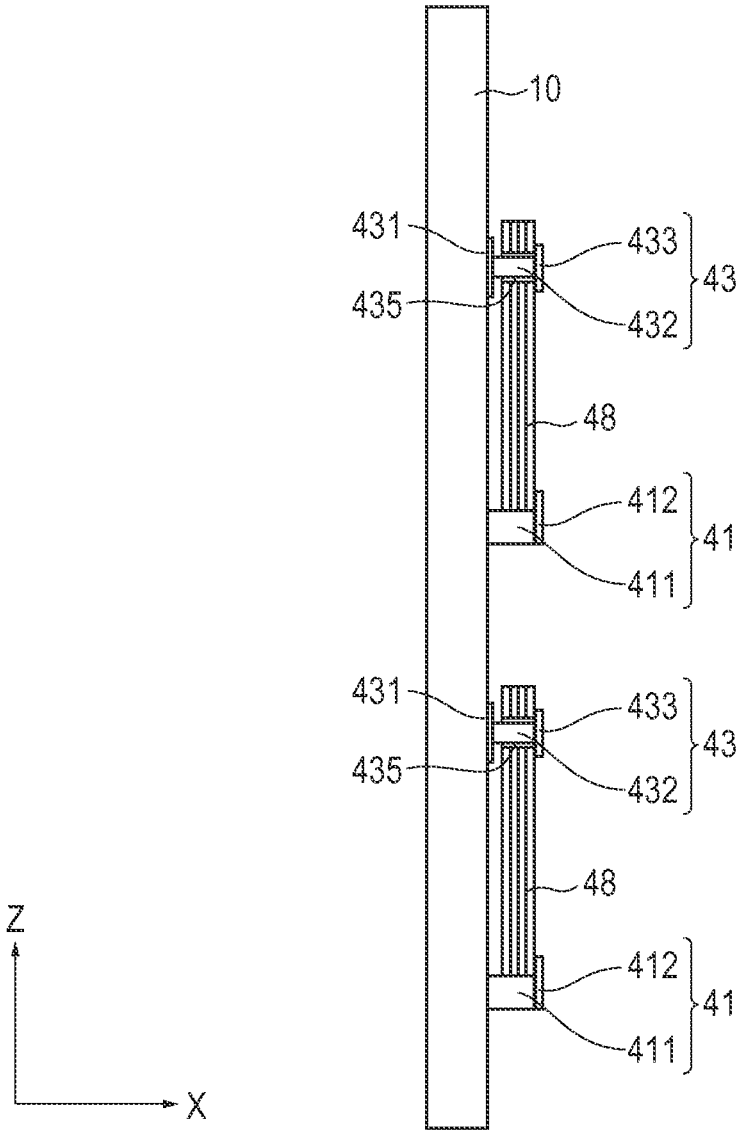
FIG. 10 is a vertical cross-sectional view taken along the line X-X of FIG. 9.

FIG. 9 is a front view for showing a structure of attaching the second magnetic shields to the tank 10. In the drawing, the first magnetic shield is not illustrated because the configuration of the second magnetic shields is shown. As shown in FIG. 9 and FIG. 10, two second magnetic shield lower support bases 411 and two second magnetic shield fixing bases 431 are provided at upper and lower positions around the middle of the inner wall of the tank.

The second magnetic shields 48 are arranged on the magnetic shield lower support bases 411 to be covered with second magnetic shield lower covers 412, and then are fixed by second magnetic shield lower cover fixing members 413 such as bolts. Accordingly, the second magnetic shields 48 can be prevented from falling from the second magnetic shield lower support bases 411.

The second magnetic shields 48 are fixed while sandwiched between the second magnetic shield fixing bases 431 and second magnetic shield covers 433. Specifically, cylindrical fixed base protruding parts 432 are provided to the second magnetic shield fixing bases 431, and are inserted into the holes provided in the magnetic shields 48. Then, the second magnetic shield covers 433 formed in an inverse C-shape are arranged at the tip ends of the protruding parts, and the both ends of the covers are fixed to the second magnetic shield fixing bases 431 through second magnetic shield cover fixing members 434 such as bolts.

The second magnetic shields 48 do not fall down because the second magnetic shields 48 are pressed by the second magnetic shield covers 433. In addition, even when a force is applied to the second magnetic shields 48, the second magnetic shields 48 are not vertically moved.

Figure 11:
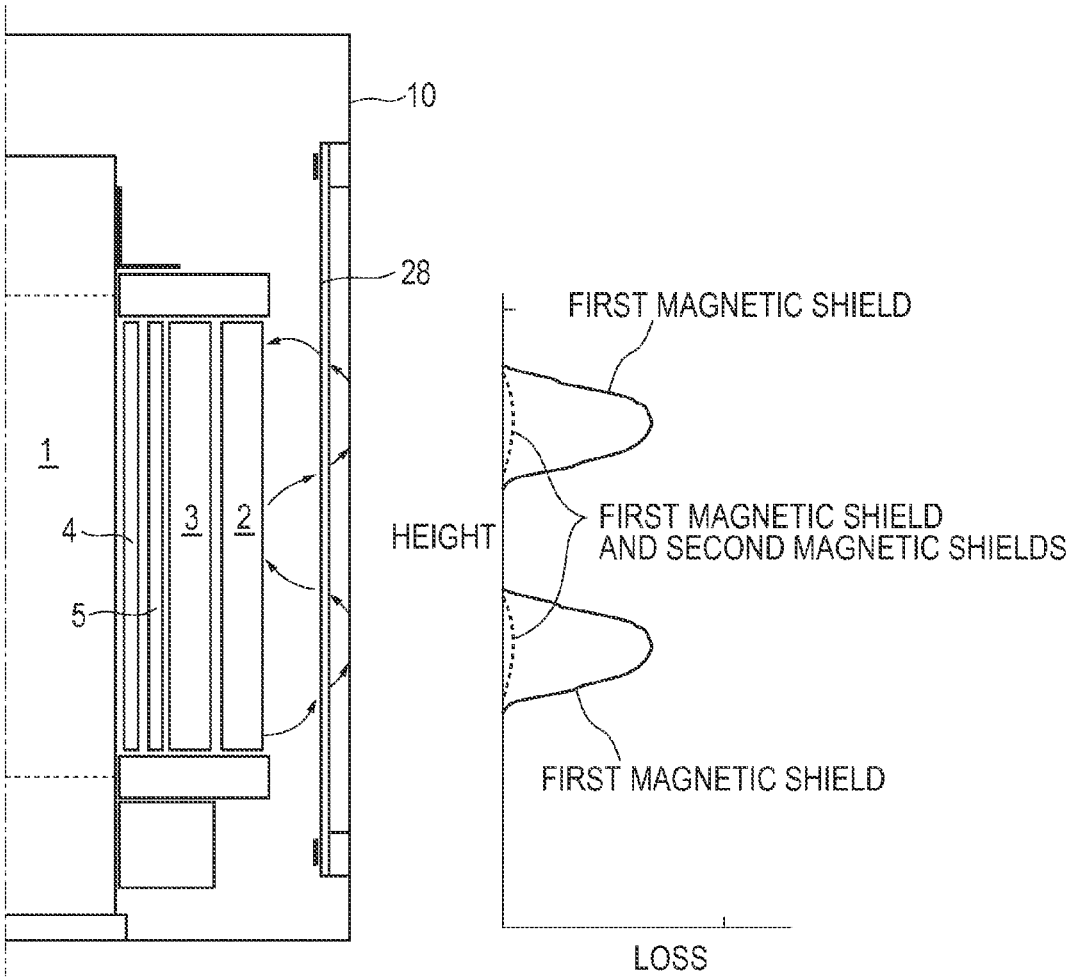
FIG. 11 shows a schematic view for showing effects of the third embodiment and a graph of loss distribution, and the height of the schematic view and the height of the graph are associated with each other.

Next, effects of the present embodiment will be described with reference to FIG. 11. FIG. 11 shows a schematic view for showing effects of the present embodiment and a graph of loss distribution, and the height of the schematic view and the height of the graph are associated with each other. The arrows in the schematic view qualitatively show the flow of magnetic flux.

For example, the magnetic flux generated from a lower end of the winding is taken into the first magnetic shield 28, and flows in the first magnetic shield 28. However, the amount of magnetic flux is large, and thus the magnetic flux is leaked on the side of the tank 10. A certain amount of magnetic flux flowing in the first magnetic shield 28 is reduced around the middle portion in the height direction. Thus, the magnetic flux is hardly leaked on the side of the tank 10. Further, the amount of magnetic flux flowing in the first magnetic shield 28 is increased as closer to an upper end of the winding, and the magnetic flux is leaked to the tank 10, resulting in the loss distribution having two peaks in the height direction as shown in FIG. 11.

In this case, there is a problem that the loss is increased as the whole transformer and the temperature is locally raised. However, in the configuration of the present invention in FIG. 8, the magnetic flux leaked on the side of the tank 10 at upper and lower portions of the winding is adsorbed by the second magnetic shields 48, and flows into the second magnetic shields 48. Thereafter, the magnetic flux returns to the first magnetic shield 28, and finally returns to an upper portion of the winding. Therefore, the magnetic flux entering the tank 10 is reduced considerably, and the loss is reduced to 10% or lower of the peak.

Two large mountains represented by solid lines in the loss distribution of FIG. 11 show effects obtained by providing only the first magnetic shield, and two small mountains represented by dotted lines show effects obtained by providing the second magnetic shields in addition to the first magnetic shield.

The required areas of the second magnetic shields 48 are narrow as compared to that of the first magnetic shield 28, and the whole weight of the magnetic shields can be minimized. Thus, the magnetic shields can be fixed using the simple attachment structures. Further, the weight of the first magnetic shield 28 is equalized with that of each second magnetic shield 48, and thus fixing members for fixing the same can be commonly used. As a result, the workability is considerably improved as compared to a case in which one magnetic shield having a heavy weight is used. Further, the oscillation can be advantageously suppressed by reducing the weight.

It should be noted that although the single-phase transformer has been described above, the present invention can be applied to a three-phase transformer, and the same effects can be obtained as well as that the present invention can be applied to a reactor.

What is claimed is:

1. A transformer comprising:

an iron core having an iron core leg and an iron core yoke;

windings wound around the iron core leg;

a tank having the iron core and the windings therein; and magnetic shields formed by laminating silicon steel sheets inside the tank, wherein the magnetic shields are configured using, at least, a first magnetic shield and second magnetic shields;

the first magnetic shield is arranged opposite to the windings;

the second magnetic shields are arranged between the first magnetic shield and the tank; and the first magnetic shield and the second magnetic shields are fixed to the tank by different support members, and wherein lower ends of the second magnetic shields are arranged at second magnetic shield lower support bases fixed to the tank and are supported by second magnetic shield lower covers fixed to the second magnetic shield lower support bases, and wherein the second magnetic shields are fixed while sandwiched between second magnetic shield fixing bases fixed to the tank and second magnetic shield covers above the second magnetic shield lower support bases and the second magnetic shield lower covers.

2. The transformer according to claim 1, wherein the windings include a high-voltage side winding, a low-voltage side winding, and a voltage switching winding;

the voltage switching winding is arranged on the side nearest to the tank; and the second magnetic shields are arranged at positions near the voltage switching winding around the middle portion of the tank in the vertical direction.

3. The transformer according to claim 1, wherein the windings include a high-voltage side winding, a low-voltage side winding, and a voltage switching winding;

the voltage switching winding is arranged on the side nearer to the iron core than the high-voltage side winding and the low-voltage side winding; and the second magnetic shields are separately arranged in the vertical direction of the tank.

4. The transformer according to claim 1, wherein support members of the first magnetic shield are arranged opposite to reinforced structural members provided on the outer surface of the tank across the tank.

* * * * *